United States Patent [19]

Coberley

[11] 4,051,815

[45] Oct. 4, 1977

[54] FLUID INJECTION APPARATUS FOR INTERNAL COMBUSTION ENGINE

[76] Inventor: Lavan E. Coberley, 2223 W. Colter, Phoenix, Ariz. 85015

[21] Appl. No.: 613,170

[22] Filed: Sept. 15, 1975

[51] Int. Cl.[2] ..... F02D 19/00

[52] U.S. Cl. ..... 123/25 A; 261/18 A

[58] Field of Search ..... 123/25 R, 25 A, 25 L, 123/25 E, 25 F; 261/18 A

[56] References Cited

U.S. PATENT DOCUMENTS

| | | | |
|---|---|---|---|
| 1,316,953 | 9/1919 | Hodges | 123/25 A |
| 1,430,803 | 10/1922 | Dunn et al. | 123/25 A |
| 1,443,116 | 1/1923 | Canova | 123/25 A |
| 1,582,089 | 4/1926 | Sidiers | 123/25 A |
| 1,641,028 | 8/1927 | Fleuker | 123/25 A |
| 2,052,608 | 9/1936 | Del Valle | 123/25 A |
| 2,099,802 | 11/1937 | Ewing | 123/25 L |
| 2,122,414 | 7/1938 | Foster | 123/25 A |
| 2,403,774 | 7/1946 | Whitty et al. | 123/25 A |
| 2,756,729 | 7/1956 | Wolcott | 123/25 L |
| 3,866,579 | 2/1975 | Serrvys | 123/25 R |

FOREIGN PATENT DOCUMENTS

| | | | |
|---|---|---|---|
| 1,098,947 | 8/1955 | France | 123/25 A |

*Primary Examiner*—Carroll B. Dority, Jr.
*Assistant Examiner*—Ira S. Lazarus
*Attorney, Agent, or Firm*—H. Gordon Shields

[57] ABSTRACT

Apparatus is disclosed for vaporizing a fluid and injecting the vaporized fluid into a carburetor of an internal combustion engine by subjecting a flow of fluid to a flow of pressurized air.

10 Claims, 13 Drawing Figures

FLUID INJECTION APPARATUS FOR INTERNAL COMBUSTION ENGINE

BACKGROUND OF THE INVENTION

1. Field of the Invention

This invention relates to internal combustion engine apparatus, and, more particularly, to apparatus for vaporizing a fluid solution and injecting the vaporized fluid into an internal combustion engine.

2. Description of the Prior Art

There are two primary ways of providing a fuel and air mixture for combustion into a cylinder of an internal combustion engine. The first way, and the most popular way with respect to the current state of the art, is by use of a carburetor in which a flow of air through the throat of a carburetor subjects fuel to low pressure created at the throat and accordingly results in a flow of fuel into the moving air stream. The air stream and the fuel mix to form a mixture of fuel and air. The flow of air in turn vaporizes, in varying degrees or in varying amounts, the fuel prior to the flow of the fuel air mixture through an intake manifold and into a cylinder.

The second method of achieving the delivery of a fuel-air mixture into the combustion chamber of a cylinder is to inject a quantity of fuel directly into an air stream. Fuel injection is a more precise method of achieving a correct fuel-air mixture in an engine than is carburation, but it is also substantially more expensive.

With both carburetion and fuel injection systems, the mixture ratio of fuel and air is predetermined according to certain parameters. Means are used to enrichen a mixture of fuel and air when such situation is desired. However, to lean, or derichen, the fuel and air mixture is not so easily accomplished.

In certain types of aircraft engines, a derichment situation occurs by the use of so-called water injection. This "water" is generally a mixture of water and alcohol and is added for two primary reasons. The first reason is to lean the fuel and air mixture to increase the power of the engine by achieving a more nearly correct fuel and air mixture ratio. The second reason is to achieve some type of cooling when the engine is running under near maximum capabilities which creates excess heat and in which such excess heat is undesirable. However, under normal running or cruising conditions the water mixture is turned off and only the regular or normal fuel and air mixture flows to the engine.

Several types of water or fluid injection systems have been used experimentally with internal combustion engines under different running conditions. Heretofore, such water or fluid injection systems have not proven entirely satisfactory for increasing either the power or the fuel economy of the engines. The systems generally include elaborate metering apparatus and accordingly are relatively expensive.

The apparatus described and claimed herein is relatively simple, compact, and efficient in accomplishing the appropriate injection of vaporized water or fluid into the air stream of the carburetor above the throttle.

SUMMARY OF THE INVENTION

The invention described and claimed herein comprises apparatus for injecting fluid into a carburetor of an internal combustion engine by subjecting the fluid to a flow of pressurized air to vaporize the fluid. The apparatus is disposed between the carburetor and the air filter on an internal combustion engine.

Among the objects of the present invention are the following:

To provide new and useful fluid injection apparatus for an internal combustion engine;

To provide new and useful apparatus for vaporizing the flow of fluid into an internal combustion engine;

To provide new and useful fluid injection apparatus for attachment to a carburetor in an internal combustion engine;

To provide new and useful apparatus for vaporizing a flow of fluid in an internal combustion engine using a flow of pressurized air; and To provide new and useful fluid injection apparatus for use with a down draft carburetor.

DESCRIPTION OF THE PREFERRED EMBODIMENTS

Figure 1:
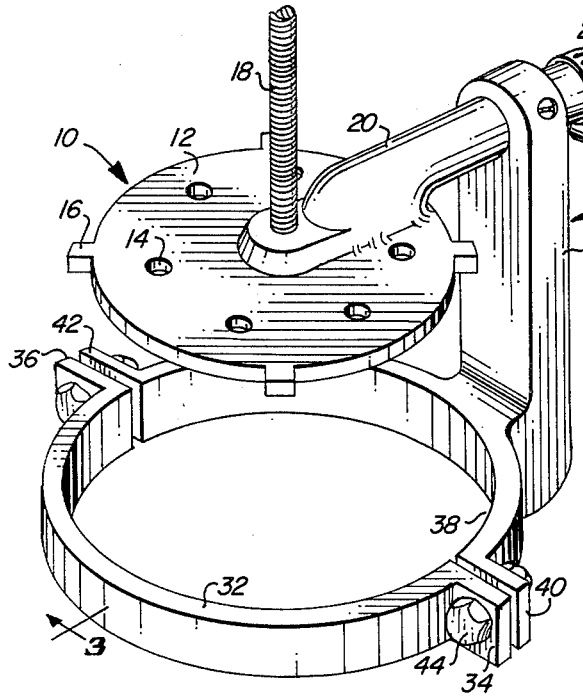
FIG. 1 is a perspective view of an embodiment of the apparatus of the present invention.

Fluid injection apparatus 10 is disclosed in FIG. 1, which comprises an isometric view of the apparatus. As illustrated herein, the particular "fluid" used will be referred to hereinafter as "water," and the apparatus will be referred to as "water injection apparatus." The water injection apparatus 10 includes a plate or bell 12 which is designed to be inserted at the top of the air horn of a carburetor. The plate or bell 12 includes a plurality of holes 14 extending through the plate and which are designed to allow air to pass through the plate from the air filter and down into and through the carburetor. A plurality of spacers 16 is shown extending radially outwardly from the plate 12. The spacers are designed to center the plate within the air horn of the carburetor. If desired, the spacers may be omitted and the plate enlarged to be of substantially the same diameter as the inside of the carburetor air horn. Air passes not only through the holes or apertures 14 through the plate, but also between the plate and the inside of the air horn, adjacent the spacer 16. If the plate is enlarged so as to omit the spacers, then the hole or apertures 14 should be enlarged to allow sufficient air to flow through the plate to provide for the proper fuel/air ratio within the internal combustion engine. This will be discussed in more detail below.

On the top of the plate 12 is shown the exterior configuration of a conduit 20. The conduit 20 is hollow on the inside to define a passageway to allow for the flow of air and the water injection fluid from a reservoir located remotely from the apparatus. The conduit is preferably a part of, or secured to, the plate. At a sufficient distance away from the plate so as to not interfere with the attachment of the air cleaner apparatus to the carburetor, as described below, the conduit 20 is secured to a mixer 24 by a connector 22. The connector 22 is illustrated in FIG. 1 as including a short length of appropriate tubing or flexible conduit material secured to both the conduit 20 and the mixer 24 by a pair of hose clamps 24. The mixer 24 includes a pair of intake ports, including a water intake port 26 and an air intake port 28. The water intake port 26 is disposed above, or in a superior position, the air intake 28.

Extending upwardly from the center of the plate 12 is a threaded rod 18. The threaded rod receives the air cleaner apparatus, and typically a wing nut is used to secure the air cleaner apparatus to the threaded rod 18. The threaded rod 18 replaces the typical threaded rod which extends upwardly from the center of an air horn of a carburetor.

A bracket 30 is used to secure the plate and its conduit to the carburetor of an engine. The bracket 30 includes a pair of clamps 32 and 38, each of which comprises a semi circle with a pair of radially outwardly extending flanges at the extremities of the semi circles which are secured together by appropriate fasteners. The clamps are secured together about the air horn of a carburetor to hold the plate in proper position with respect to the carburetor. The clamp 32 includes a pair of outwardly extending flanges 34 and 36, and the clamp 38 includes a pair of flanges, flange 40 and flange 42, which mate respectively with flanges 34 and 36 of clamp 32. As illustrated in FIG. 1, appropriate fasteners, such as bolts 44 may be used to secure the two clamps together through their respective flanges.

The clamp 38 is secured to an upwardly extending arm 46 which is also secured to the conduit at 20 at its upper portion. The arm 46 is appropriately dimensioned so as to position the plate properly with respect to the air horn of a carburetor on which the apparatus is secured.

Figure 2:
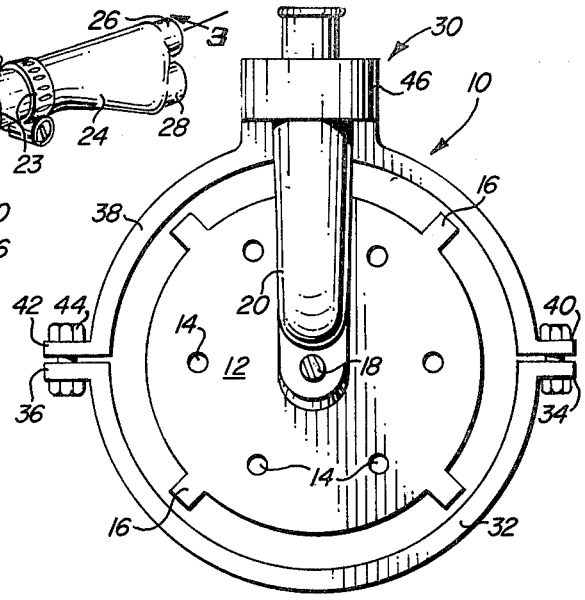
FIG. 2 is a top view of the apparatus of FIG. 1.

FIG. 2 is a top view of the apparatus of FIG. 1 and it clearly illustrates the relationship between the various components of the water injection apparatus 10. Plate 12, with its plurality of holes 14, and its spacers 16, is shown substantially centered within the clamps 32 and 38. The space between the outer edges of the radially outwardly extending spacers 16 and the inside surfaces of the clamps 32 and 38 is substantially the thickness of the air horn of a carburetor on which the apparatus is installed so as to securely position the water injection apparatus 10 with respect to the carburetor. The clamps are secured together at their radially outwardly extending flanges 34, 40 and 36, 42, by bolts 44. The clamps in turn position the plate 12 through arm 46 and hold the plate with respect to the carburetor, with the spacer 16 positioning the plate 12 centrally with respect to the air horn of the carburetor.

The threaded rod 18 is shown substantially in the center of the apparatus which allows the carburetor air filter apparatus to be secured in its appropriate position with respect to the carburetor.

Conduit 20, secured to the top of the plate 12, extends outwardly with respect to the plate and also with respect to the clamps, and is secured to the clamp 38 by a bracket 30, of which only the upwardly extending arm 46 is shown in FIG. 2. The arm connects the clamp 38 to the conduit 20.

Figure 3:
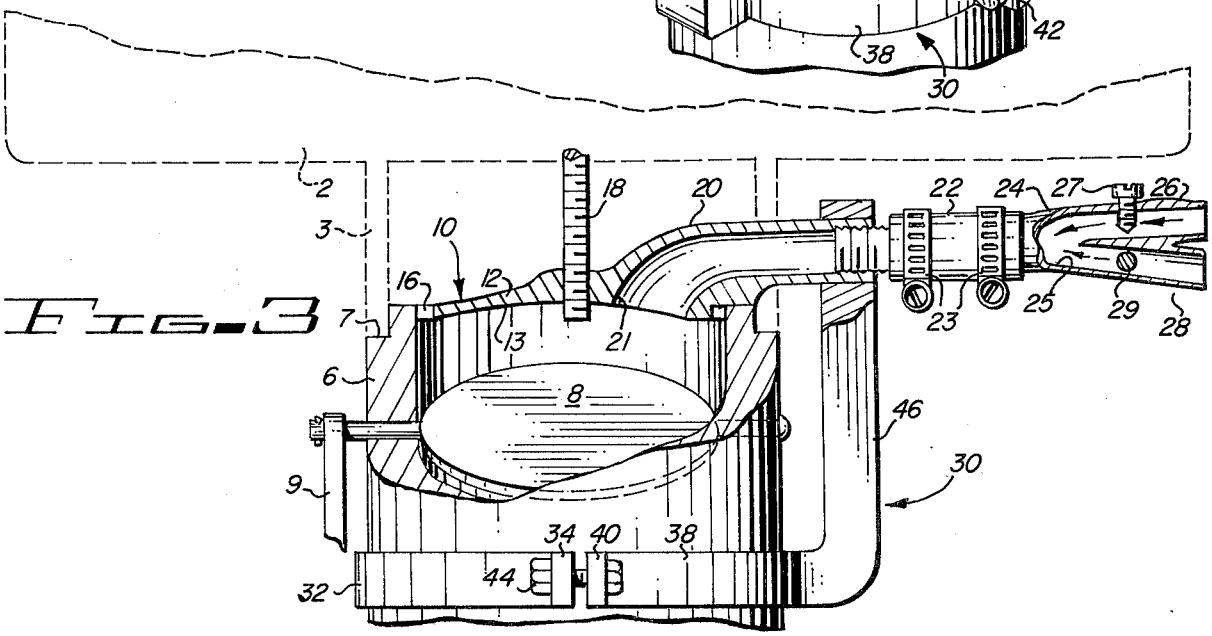
FIG. 3 is a side view of the apparatus of FIG. 1 in partial section installed on a carburetor, and taken generally along line 3—3 of FIG. 1.

FIG. 3 is a view of the apparatus of FIG. 1 taken generally along 3—3 of FIG. 1, and illustrating the installation of the water injection apparatus 10 on a carburetor. The apparatus 10 is shown secured to a carburetor air horn 6, which is shown in partial section. A portion of the air horn 6 is broken away to show the relationship of the apparatus 10 to a choke 8 and choke linkage 9 disposed in the upper portion of the air horn 6.

Plate 12 is shown disposed within the interior of the air horn 6 at the upper portion thereof.

The air horn 6 includes a shoulder or step 7 on the exterior periphery of the top of the air horn which is designed to receive the lower portion of air cleaner apparatus 2, shown in phantom. The air cleaner, with its filter disposed within the housing of the air cleaner, is held to the carburetor by means of an appropriate fastener, such as a wing nut, on the threaded rod 18. Normally, a threaded rod, such as rod 18, extends upwardly through the choke, such as choke 8 in FIG. 3. However, since the water injection apparatus 10 is disposed within the air horn of the carburetor, the usual threaded rod is replaced by the threaded rod 18 which is secured to the plate 12. In turn, the water injection apparatus 10 is secured to the air horn 6 of the carburetor through bracket 30. The bracket 30 extends from the pair of clamps 32 and 38 to the conduit 20 by means of the arm 46, secured to both the conduit 20 and the clamp 38. The clamps 32 and 38 are secured together at their flanges 34 and 40 by appropriate fastening means, such as bolt 44.

The plate 12 includes a concave bottom surface 13. The conduit 20 communicates with the plate 12 at the underneath surface of the plate 13 through an aperture or opening 21.

Conduit 20 is connected to mixer 24 by the flexible connector 22, which is in turn secured to both the conduit and the mixer by a pair of hose clamps 23, or other appropriate fasteners.

The mixer 24 comprises a junction for the water intake line 26 and the air intake line 28. The respective intake lines join together at a chamber 25 within the mixer 24. As indicated previously, the water intake line 26 is superior to, or disposed above, the air intake line 28. Both lines include valves, which are schematically represented by a needle valve 27 in line 26 and a needle valve 29 in intake line 28, to enable the flow of both the water and the air to be adjusted, as desired.

The flow of water is relatively slow, as compared to the flow of pressurized air through the air intake line 28. The water, by comparison, provides only a steady "drip" as opposed to the flow of the pressurized air which vaporizes the water between the chamber 25 of the mixer 24 and the opening or orifice 21 at the juncture of conduit 20 and plate 12. The distance between the chamber 25 and the opening 21 is preferably several inches so as to provide sufficient time for the flow of air to vaporize the water (or fluid) before the air and water introduced into the carburetor.

The flow of pressurized air through air intake line 28 and conduit 20 provides a substantial amount of air for the combustion processes to occur within the engine. That is, while there is a plurality of holes in the plate 12, to allow for the flow of air through the air cleaner apparatus into the carburetor, the flow of pressurized air through the fluid injection apparatus provides sufficient air to overcome the restriction of the plate and of the apparatus with respect to the normal air flow through a carburetor to provide for the correct air/fuel ratio. Moreover, the flow of air may be adjusted by a needle valve or other appropriate valve means, such as indicated by reference numeral 29 in FIG. 3, to control the flow of air from the intake line 28 to the mixer chamber 25 and hence into the carburetor.

For controlling the flow of fluid into the chamber 25, where the fluid is mixed with the air through the intake line 28, appropriate valve apparatus, such as schematically illustrated in FIG. 3 by a needle valve 27, is provided. By means of both valves 27 and 29, the appropriate flow of fluid and air may be controlled as desired.

Figure 4:
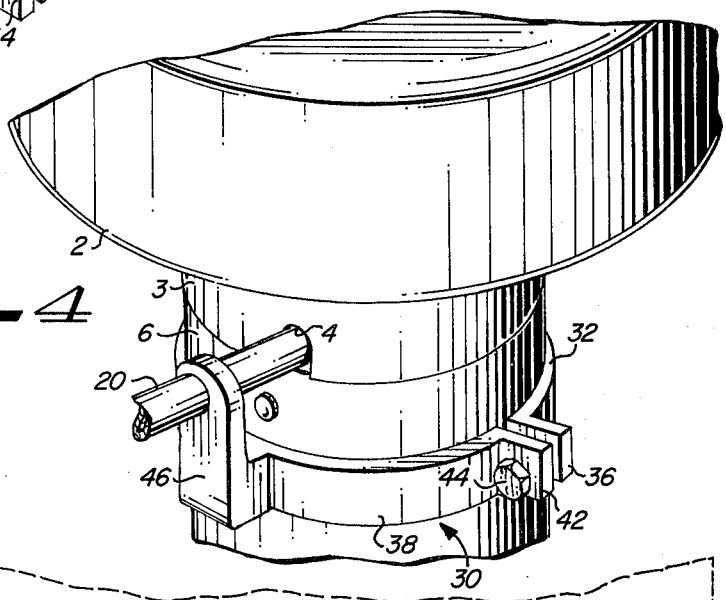
FIG. 4 is a perspective view of apparatus of the present invention disposed between an air filter and a carburetor.

FIG. 4 is a perspective view of the apparatus of the present invention disposed between an air filter and a carburetor. The air horn 6 of a carburetor is shown with air cleaner apparatus 2 disposed on the air horn. The air cleaner apparatus includes a connector portion 3 which is disposed on the shoulder or step 7 (see FIG. 3) of the air horn. The connector portion 3 includes a notch 4 through which extends the conduit 20 of the water injection apparatus. The water injection apparatus is secured to the air horn by means of the clamps 32 and 38, which are shown secured together by a bolt 44 through their respective flanges 36 and 42. The arm 46 is shown secured to the clamp 38 and extending upwardly to the conduit 20.

Since the conduit 20 extends above the air horn and outwardly from the carburetor, the notch 4 is required to permit the connector portion 3 of the air cleaner apparatus 2 to be secured to the carburetor in its normal fashion, and yet allow the water of fluid injection apparatus to be inserted into the carburetor, as illustrated in FIG. 3.

Figure 5:
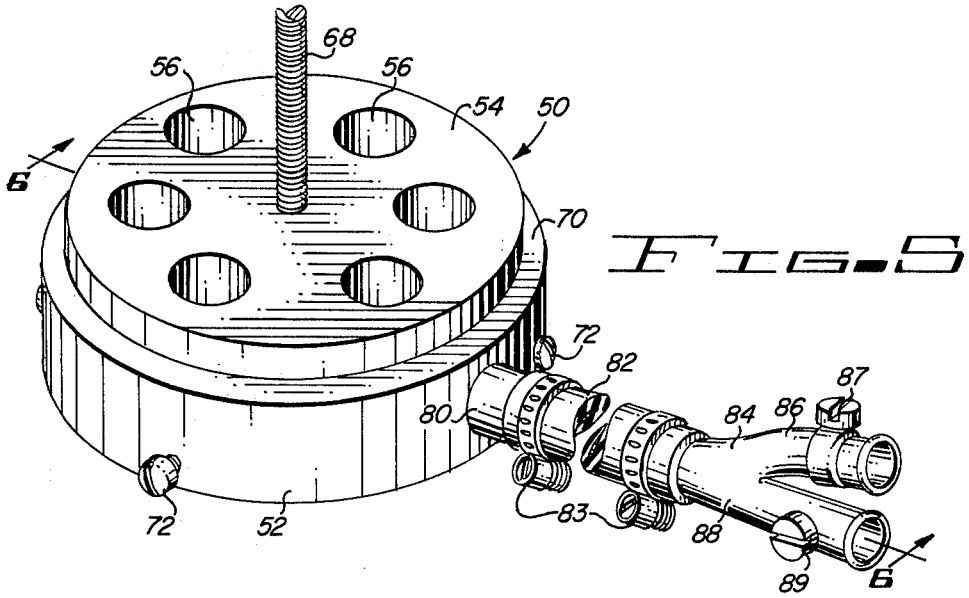
FIG. 5 is an isometric view of an alternate embodiment of the present invention.

An alternate embodiment of the fluid injection apparatus is illustrated in FIG. 5. In the embodiment of FIG. 5, the necessity for the bracket illustrated in FIG. 1–4 is eliminated.

Fluid injection apparatus 50 includes a generally cylindrical housing 52 closed at its upper portion by a top plate 54. A shoulder or step 70 is defined at the upper portion of the housing between the cylindrical housing 52 and the top plate 54. A plurality of holes or apertures 56 extend through the top plate 54 and provide for the passage of air from air cleaner apparatus, disposed on the shoulder 70 above the fluid injection apparatus 50, through the top plate and the apparatus and into the carburetor on which the fluid injection apparatus 50 is disposed and to which it is secured. The flow of air through the apertures 56 is, of course, augmented by a flow of pressurized air, as will be discussed in detail below and as previously discussed in conjunction with the embodiment of FIGS. 1–4.

Extending upwardly from the top plate 56, and centrally disposed with respect thereto, is a threaded rod 68 which is used to secure air cleaner apparatus 102, shown in phantom, including an air filter, to the engine and carburetor through the fluid injection apparatus 50. This is substantially the same as the threaded rod 18 and the air cleaner apparatus 2 discussed above in conjunction with FIGS. 1–4.

A plurality of appropriate fasteners, such as screws 72, are located about the periphery of the cylindrical housing 52 and are used to secure the apparatus to the air horn of a carburetor.

Extending radially outwardly from the cylindrical housing 52 is a conduit 80 which provides for the flow of air and water from external sources into the cylindrical housing 52. The conduit 80 is in turn secured to a mixer 84 by means of a flexible connector 82. The connector 82 is secured to both the conduit and the mixer by a pair of hose clamps 83, or other appropriate fasteners. The mixer 84 includes a bifurcated portion, comprising a pair of inlets, including water (fluid) inlet 86 and air inlet 88. Each of the inlets includes appropriate valve means for controlling the flow of the respective water and air, such as needle valve 87 and needle valve 89 in the water (fluid) inlet and air inlet lines, respectively. As in the previous embodiment, the water (fluid) line is appropriately disposed above the air line such that the flow of water or fluid, by gravity, is downwardly and into the flow of pressurized air through the air inlet line. The length of conduit 80, and also that of connector 82, may be as desired to give the appropriate spacing between the mixer 84 and the cylindrical housing 52 to provide for the vaporization of the water or fluid by the flow of pressurized air.

Figure 6:
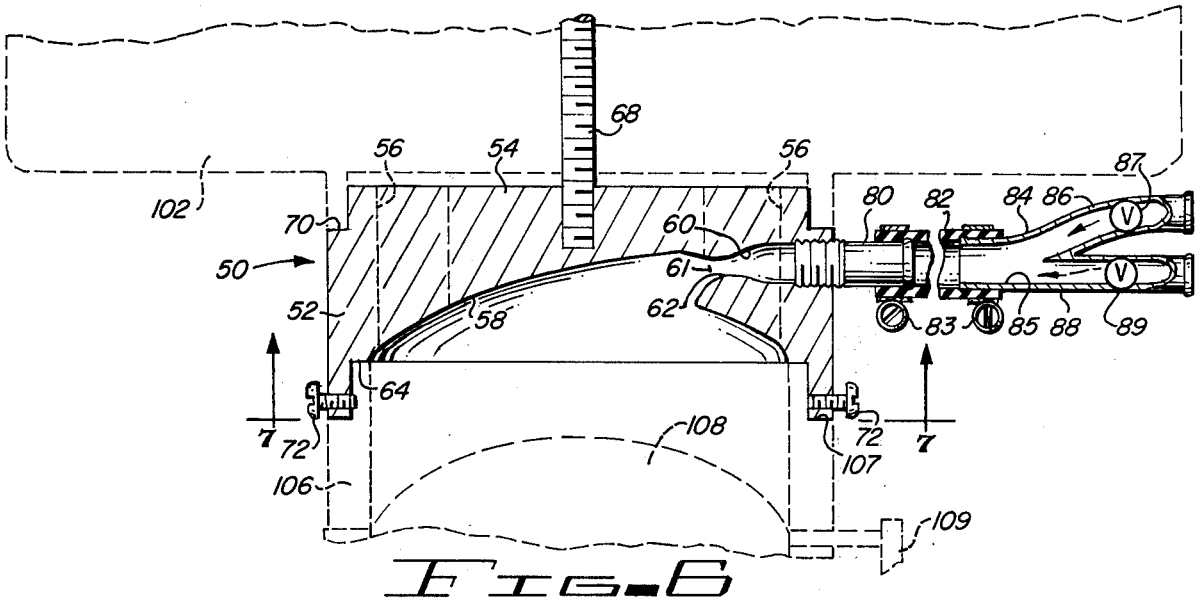
FIG. 6 is a view in partial section of the apparatus of FIG. 5 taken generally along line 6—6 of FIG. 5.

FIG. 6 is a view in partial section taken generally along the line 6—6 of FIG. 5, and showing the apparatus 50 in a use environment. The apparatus 50 is shown disposed on a carburetor air horn 106, shown in phantom, with air cleaner apparatus 102 shown disposed on the fluid injection apparatus 50. The air cleaner apparatus 102 is also shown in phantom and may be appropriately secured to the threaded rod 68, as by a wing nut, or the like.

The cylindrical housing 52 is shown disposed on a shoulder or step 107 of the carburetor air horn 106. The cylindrical housing 52 includes an internal shoulder or step 64 which matingly engages the shoulder or step 107 to allow for the engagement and securement of the fluid injection apparatus with the carburetor. The plurality of screws 72 are shown against the air horn to hold the water or fluid injection apparatus in place. The screws extend through the apparatus in threaded apertures in the housing 52. If desired, appropriate gaskets may be used to provide a seal between the carburetor and the water or fluid injection apparatus 50, and also between the water or fluid injection apparatus and the air clearner apparatus.

Holes or apertures 56 extend through the top plate 54 of the housing 52. The flow of air through the apertures 56 is sufficient, in addition to the flow of air through the air intake line 88, the connector 82, and the conduit 80, to provide the proper amount of air for the combustion of the fuel within the engine.

The housing 52 and top plate 54 include a concave or domed portion 58 on the underneath side of the top plate 54. The internal configuration of the domed or concave portion is for the purpose of directing the flow of air and water downwardly through the air horn of the carburetor and into the intake manifold in a flow of generally uniform density.

The conduit 80 communicates with the domed or concave portion 58 of the cylinder 52 through an internal conduit 60 and an opening 61 at the juncture of the concave portion 58 and the conduit 60. The internal conduit 60 includes a venturi or other appropriate restriction 62 adjacent the concave portion 58. The venturi or restriction 62 is used to enhance the flow of water or fluid and air from the conduit 80 and internal conduit 60 and into the concave portion 58 of the housing 52.

FIG. 6 illustrates in partial section the connection between the mixer 84 and the conduit 80 by means of connector 82 and the hose clamps 83. Within mixer 84 is a chamber 85 adjacent the convergence of the water inlet line 86 and the air inlet line 88. Both inlet lines include appropriate valves 87 and 89 to allow for the control, respectively, of the water and air into the chamber 85 and accordingly into the conduit 80 and hence into the carburetor of the engine to which the apparatus is secured.

The air cleaner apparatus 102 is shown in phantom in FIG. 6 as surmounting the water injection apparatus 50. The air cleaner is shown disposed on an external shoulder or step 70, which is substantially identical to the shoulder or step 107 on the air horn 106. The water or fluid injection apparatus 50 accordingly is disposed between the air cleaner and the carburetor and serves only to increase the height of the carburetor with respect to the air cleaner. Since the water fluid injection apparatus 50 provides a shoulder or step, which is substantially identical to that on the carburetor, the air cleaner rests directly on the water or fluid injection apparatus and is secured thereto by means of the threaded rod 68, as discussed above.

Figure 7:
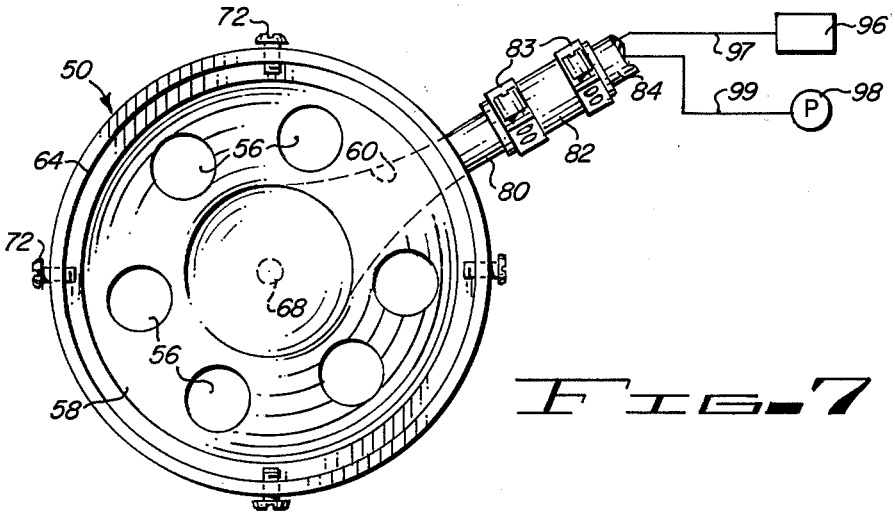
FIG. 7 is a bottom view of the apparatus of FIG. 5, taken generally along line 7—7 thereof.

FIG. 7 is a view of the apparatus of FIG. 6 taken generally along line 7—7, and it comprises a bottom view, looking upwardly, of the fluid injection apparatus 50. The cylindrical housing 52 is shown with its internal shoulder or step 64 which matingly engages the external step or shoulder of the carburetor (see FIG. 6). Four screws 72 are shown extending radially inwardly through the housing 52. They extend through the housing in internally threaded or tapped apertures and they engage the carburetor so as to hold the water injection apparatus 50 thereto.

The internal conduit 60 communicates with the concave portion 58 of the housing 52 and provides an internal passageway through the housing from the conduit 80, exteriorly of the housing. The conduit 80 is in turn secured to a connector 82 by means of a hose clamp 83 and, on the opposite end of connector 82, remote from conduit 80, the connector is secured to a mixer 84.

Schematically represented in FIG. 7 is a fluid container or tank 96 and an air pump 98. Both the tank 96 and pump 98 are schematically illustrated as being connected to the mixer 84 by appropriate conduits 97 and 99, respectively. The conduits 97 and 99 in turn connect with the intake lines 86 and 88, illustrated in FIGS. 5 and 6. The tank 96 is preferably located above the apparatus 50 so as to allow the fluid to flow from the tank by gravity to the apparatus. The tank may be made of any appropriate material, such as plastic or metal, and it includes an appropriately vented cap through which the tank may be filled. The tank is vented to prevent a problem with respect to the flow of fluid due to a partial vacuum building up within the tank.

The pump or compressor 98 is preferbly a constant speed pump having an output varying between 5 and 20 p.s.i.g. The pump may be engine driven directly from the engine or it may be electric, powered from the electrical system of the vehicle, as desired.

Due to space limitations underneath the hood of an automobile, it may not be possible or practical to have the water container 96 disposed above the apparatus so as to provide for the gravity flow of the water or fluid to the injection apparatus. Under such circumstances, it may be necessary to also provide a pump for the water or fluid mixture. Again, a constant speed pump may be used, or, under certain circumstances, as when high performance is required, positive displacement pumps may be used for both the water and the air.

Figure 8:
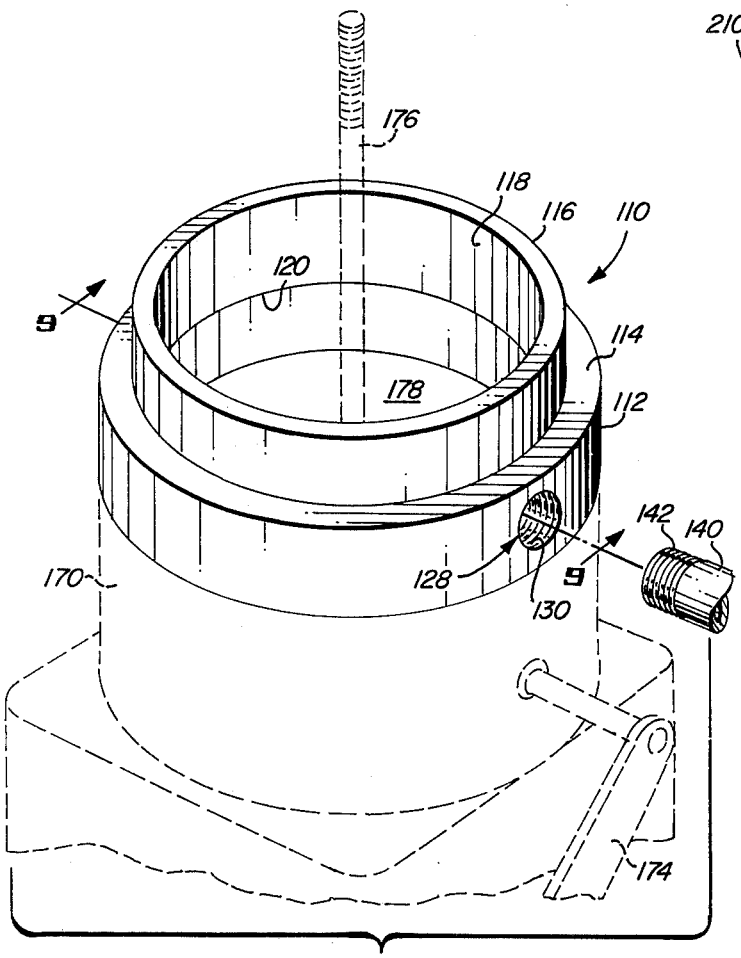
FIG. 8 is an isometric view of an alternate embodiment of the apparatus of the present invention.

FIG. 8 is a perspective view of an alternate embodiment of the apparatus of the present invention, similar to the embodiment of FIGS. 5–7. The alternate embodiment comprises water injection apparatus 110 shown disposed on a carburetor air horn 170. Choke linkage 174 is shown extending from the air horn 170. Both the air horn and the choke linkage are shown in phantom.

Figure 9:
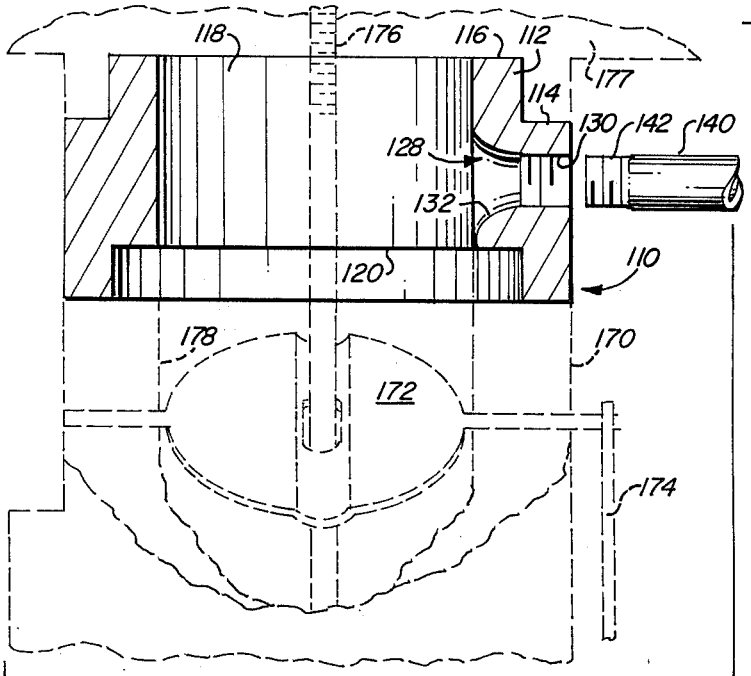
FIG. 9 is a view of the apparatus of FIG. 8 in partial section taken generally along line 9—9 of FIG. 8.

The injection apparatus 110 includes a cylindrical housing 112 which is disposed on the air horn 170. The cylindrical housing includes an exterior shoulder 114 which comprises a step on which is disposed the air cleaner apparatus, such as discussed and shown above in conjunction with FIGS. 1–7 and as also shown in FIG. 9. At the upper or top portion of the cylindrical housing 12 is a top rim 16. The rim is above the external shoulder or step 114. Within the cylindrical housing is an interior bore 118 which extends axially with respect to the housing 112. The bore 118 provides for a substantially unrestricted flow of air from the air filter through the carburetor and into the intake manifold of an engine. Extending upwardly centrally within the bore 118 is a threaded rod 176, shown in phantom. The threaded rod 176 is that which is commonly used to secure air filter or cleaner apparatus to the carburetor of an engine. In the embodiment of FIGS. 1–7, a threaded rod has been supplied with the water injection apparatus and which takes the place or is used instead of the threaded rod normally found in carburetor apparatus, such as the threaded rod 176.

An aperture 128 is shown extending through the lower portion of the cylindrical housing 112. The aperture includes an internally threaded portion 130. The aperture 128 provides for the flow of air and water from an external source, such as conduit 140. The conduit includes an externally threaded portion 142 which threadedly engages the internally threaded portion 130 of the aperture 128. The conduit 140 is substantially identical to the conduit disclosed above in conjunction with FIGS. 1–7.

FIG. 9 is a view of the apparatus of FIG. 8 in partial section taken generally along line 9—9 of FIG. 8, and illustrating the installation and functioning of the water injection apparatus 110 of FIG. 8. The cylindrical housing 112 shown in partial section, disposed on the carburetor air horn 170 and beneath air filter apparatus 177. Both the air horn 170 and the air filter apparatus 177 are shown in phantom, and each of them comprises only fragmentary portions of the apparatus, simply illustrating the installation of the injection apparatus 110.

The cylindrical housing 112 is shown disposed on an external shoulder of the air horn 170, with an internal shoulder 120 of the cylindrical housing 112 matingly engaging the external shoulder of the air horn 170. Similarly, the air filter apparatus 177 is shown disposed on the external shoulder 114 of the housing 112. If the cylindrical housing 112 were removed, the air filter apparatus 177 would be disposed directly on the air horn 170. Beneath the cylindrical housing 112, and within the air horn 170, is shown a choke 172 connected to the choke linkage 174. Extending through the choke 172 is the threaded rod 176 to which the air filter apparatus 177 is secured. By securing the air filter apparatus 177 to the threaded rod 176, the air filter and the injection apparatus are both secured to the carburetor. As shown in FIG. 9, the housing 112 comprises a plate with a relatively large bore 118 disposed on the carburetor and with an aperture extending through the housing defining an internal conduit communicating with the external conduit 140 and with the bore.

The internal bore 118 is substantially co-extensive with the inside of the carburetor air horn, defined by a passageway 178. In the embodiment of FIGS. 8 and 9, the flow of air from the air filter 177 to the cylindrical housing 112 and into the carburetor is unimpeded.

The conduit 128 extends through the cylindrical housing 112 and terminates at the interior bore 118 in a flared outlet or opening 132. The flared opening 132 is substantially symmetrical with respect to the aperture 128. That is, the outlet diverges or flares outwardly to terminate at the interior bore 118 in a substantially symmetrical and enlarged opening.

The conduit 140 is shown spaced apart from the threaded inlet portion 130 of the aperture 128. The flow of air and water (fluid) through and from the conduit 140 into the aperture 128 flows into the bore 118 where it mixes with the flow of air from the air filter apparatus and is accordingly carried into and through air filter apparatus and is accordingly carried into and through the carburetor and into the intake manifold of the engine. The outwardly flaring outlet or opening 132 allows the flow of air and fluid to spread outwardly rather than to be directed directly radially inwardly and also to flow upwardly, downwardly, and perpendicularly inwardly with respect to the flow of air from the air filter apparatus into the carburetor. If desired, obviously the outwardly flared portion 132 could be eliminated and under such circumtances the aperture 128 would have the same diameter throughout its length through the cylindrical housing 112.

Figure 10:
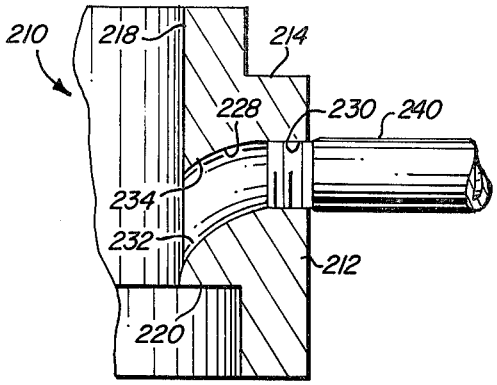
FIG. 10 is an enlarged sectional view of a portion of the apparatus of FIGS. 8 and 9 with a modification thereto.

FIG. 10 is an enlarged sectional view of a portion of the apparatus of FIGS. 8 and 9 illustrating a modification thereto. Injection apparatus 210 of FIG. 10 includes a cylindrical housing 212 which is substantially the same as the cylindrical housing 112 of FIGS. 8 and 9. The cylindrical housing 212 includes an exterior shoulder or step 214 and an interior shoulder or step 220, both of which are complimentary with respect to their dimensions. The interior step or shoulder 220 is adapted to be disposed on an external shoulder of a carburetor air horn, and the external or exterior step 214 is adapted to receive air filter apparatus thereon. The interior of the cylindrical housing 212 includes a bore 218 through which the air flows from the air filter apparatus to the engine.

The cylindrical housing 212 includes an aperture 228 extending through the housing and communicating with the interior bore 218. A conduit 240 is shown threadedly engaging a threaded inlet portion 230 of the aperture 228. The conduit 240 prvovides for the flow of fluid and air to the housing 212. The aperture 228 curves downwardly from the internally threaded inlet portion 230 and it includes a downwardly flaring bottom outlet portion 232 and a downardly flaring top outlet portion 234. The distance between the top and bottom outlet portion 232 and 234 is greater than the diameter of the aperture at the threaded inlet portion 230. Moreover, as may be seen in FIG. 11, the outlet portions also flare outwardly sideways, to define an increased width at the bore 218. The downwardly flaring portions direct the flow of fluid and air downwardly and into the carburetor air horn.

Figure 11:
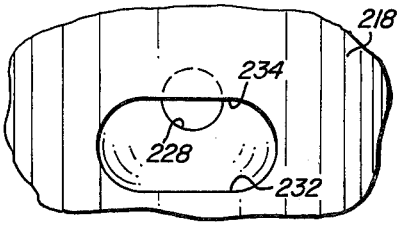
FIG. 11 is an enlarged fragmentary view of a portion of the apparatus of FIG. 10.

FIG. 11 is an enlarged fragmentary view of a portion of the apparatus of FIG. 10, comprising a front view of the aperture 228 at the bore 218. The aperture 228 flares downwardly and increases in height between the bottom portion 232 and the upper portion 234 with respect to the diameter of the aperture 228 at the threaded inlet portion 230 (see FIG. 10). The aperture 228 also flares outwardly to substantially increase in width over the said diameter. The increase in the width of the aperture at the bore 218 allows the fluid and air to diverge into the airstream of the carburetor and the downward curve directs the fluid and air downwardly so as to meet the air stream at an acute angle.

Figure 12:
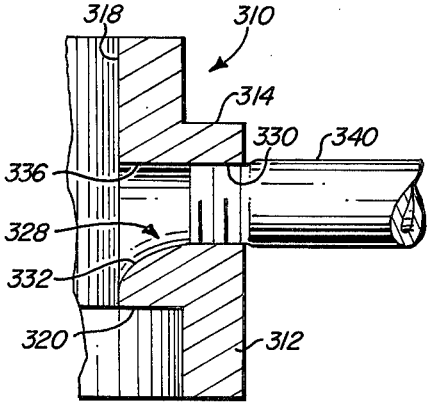
FIG. 12 is an enlarged view and partial section of a portion of the apparatus of FIGS. 8 and 9, similar to that of FIG. 10, illustrating another modification thereof.

FIG. 12 is an enlarged sectional view of a portion of the apparatus of FIGS. 8 and 9 illustrating another modification thereto. Injection apparatus 310 of FIG. 12 includes a cylindrical housing 312 which is substantially the same as the cylindrical housing 112 of FIGS. 8 and 9. The cylindrical housing 312 includes an exterior shoulder or step 314 and an interior shoulder or step 320, both of which are complimentary with respect to their dimensions. The interior step or shoulder 320 is adapted to be disposed on an external shoulder of a carburetor air horn, and the external or exterior step 214 is adapted to receive air filter apparatus thereon, substantially similar to that shown in FIG. 9. The interior of the cylindrical housing 312 includes a bore 318 through which air flows from the air filter apparatus to the engine.

The cylindrical housing 312 includes an aperture 328 extending through the housing and communicating with the interior bore 318. A conduit 340 is shown threadedly engaging a threaded inlet portion 330 of the aperture 328. The conduit 340 provides for the flow of fluid and air to the housing 212. The aperture 328 curves downwardly at its lower portion from the internally threaded inlet portion 330 to define a downwardly flaring bottom outlet portion 332 at the bore 318. The upper portion of the aperture 318 continues through the housing in a straight line manner and terminates at a top outlet portion 336. The distance between the top and bottom outlet portion 332 and 336 is greater than the diameter of the aperture at the threaded inlet portion 330. Moreover, as may be seen in FIG. 13, the outlet portions also flare outwardly sideways, to define an increased width at the bore 318. The downwardly flaring portion directs part of the flow of fluid and air downwardly and into the carburetor air horn, while the straight upper portion allows some of the flow to go perpendicularly into the flow of air from the air filter into the carburetor.

Figure 13:
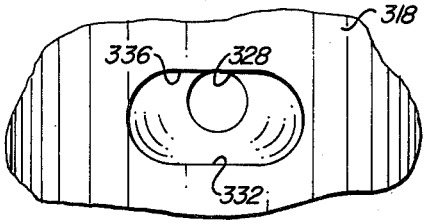
FIG. 13 is an enlarged fragmentary view of a portion of the apparatus of FIG. 12.

FIG. 13 is an enlarged fragmentary view of a portion of the apparatus of FIG. 12, comprising a front view of the aperture 328 at the bore 318. The aperture 328 flares downwardly and increases in height between the bottom portion 332 and the upper portion 336 with respect to the diameter of the aperture 338 at the threaded inlet portion 330 (see FIG. 12). The upper outlet portion 336 extends straight out, or axially, with respect to the aperture 328 at the inlet portion 330. The aperture also flares outwardly to substantially increase in width over the said diameter. The increase in the width of the aperture at the bore 318 allows the fluid and air to diverge into the airstream of the carburetor and the downward curve directs a portion of the fluid and air downwardly as as to meet the air stream at an acute angle and allows another portion to flow outwardly into the air flow perpendicular to the air flow.

The outlets at the bores of the housings in the embodiments of FIGS. 8–13 provide different types of openings for the flow of air and water (fluid) into the air flow or air stream into the carburetor and may be adapted or varied to single-barrelled or multi-barrelled carburetors. A flared outlet or opening at the bore may be preferable for use with multi-barrel carburetors. However, obviously the specific opening at the bore may be varied or adapted to any particular carburetor.

While the terms "water" and/or "fluid" have been used throughout the specification, a combination of alcohol and distilled water is preferable to merely water without some type of additive. Water and alcohol solutions have been known and used for many years, primarily in conjunction with aircraft engines. With respect to the present apparatus, a two to one alcohol to water ratio is preferable. For example, if the tank 96 (see FIG. 7) had a one gallon capacity, the "water" solution therein would preferably be about two and two-thirds quarts of alcohol to one and one third quarts of distilled water. Other types of fluids may also be used with the apparatus. The terms "water" and "fluid" as used herein refer to liquids which are capable of vaporization by an air stream, such as, but not limited to, as indicated, water or a water and alcohol combination.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. For example, the relative size and/or number of the holes or the size of the bores may vary or be varied for a particular engine or carburetor. The appended claims are intended to cover and embrace any and all such modifications, within the limits only of the true spirit and scope of the invention.

What is claimed is:

1. In combination with an internal combustion engine having a carburetor, an apparatus for injecting fluid into said carburetor, said apparatus comprising:

plate means connected to the carburetor of an internal combustion engine;

a pump for providing a flow of pressurized air;

conduit means secured to the plate means for providing a flow of fluid and pressurized air to the plate means;

a first intake line secured to the conduit means and to the pump for providing a flow of pressurized air to the conduit means;

a second intake line secured to the conduit means and disposed directly above the first intake line for providing a flow of fluid to the conduit means;

a mixer chamber in the conduit means at the juncture of the first and second intake lines and spaced apart from the plate means for mixing the flow of pressurized air and the flow of fluid together; and an opening at the juncture of the conduit means and the plate means through which the flow of fluid and air flows into the carburetor.

2. The apparatus of claim 1 in which the plate means includes at least a single aperture extending through the plate means for providing another flow of air through the plate means.

3. The apparatus of claim 2 in which the plate means further includes a concave surface disposed about the opening at the juncture of the plate means and the conduit means.

4. The apparatus of claim 2 which includes means for controlling the flow of air and the flow of fluid.

5. The apparatus of claim 4 in which the means for controlling the flow of air and the flow of fluid includes valve means in the first intake line and valve means in the second intake line.

6. The apparatus of claim 5 in which the means for controlling the flow of air and the flow of fluid further includes a restriction in the conduit means adjacent the opening at the juncture of the plate means and the conduit means.

7. The apparatus of claim 4 in which the plate means further includes means for securing the plate means to an internal combustion engine.

8. The apparatus of claim 1 in which the plate means comprises housing means having a bore extending through the housing means.

9. The apparatus of claim 8 in which the conduit means includes an aperture extending through the housing means and defining an internal conduit.

10. The apparatus of claim 9 in which the opening at the juncture of the conduit means and the plate means comprises a flared outlet at the bore of the housing means.

* * * * *